US009456720B2

(12) United States Patent
Catalfamo

(10) Patent No.: US 9,456,720 B2
(45) Date of Patent: Oct. 4, 2016

(54) PNEUMATIC VACUUM CLEANER

(76) Inventor: Pasquale Catalfamo, Varese (IT)

( * ) Notice: Subject to any disclaimer, the term of this patent is extended or adjusted under 35 U.S.C. 154(b) by 666 days.

(21) Appl. No.: 13/820,429

(22) PCT Filed: Sep. 14, 2011

(86) PCT No.: PCT/IB2011/054023

§ 371 (c)(1),
(2), (4) Date: Mar. 29, 2013

(87) PCT Pub. No.: WO2012/035503

PCT Pub. Date: Mar. 22, 2012

(65) Prior Publication Data

US 2013/0232723 A1 Sep. 12, 2013

(30) Foreign Application Priority Data

Sep. 14, 2010 (IT) ..... MI2010A1673

(51) Int. Cl.

| | |
|---|---|
| ***A47L 5/16*** | (2006.01) |
| ***F04F 5/44*** | (2006.01) |
| ***A47L 5/18*** | (2006.01) |
| ***F04F 5/46*** | (2006.01) |
| ***B08B 5/04*** | (2006.01) |
| ***B08B 15/04*** | (2006.01) |
| ***B24B 55/06*** | (2006.01) |

(Continued)

(52) U.S. Cl.

CPC . *A47L 5/18* (2013.01); *B08B 5/04* (2013.01); *B08B 15/04* (2013.01); *B24B 55/06* (2013.01); *F04F 5/00* (2013.01); *F04F 5/20* (2013.01); *F04F 5/467* (2013.01)

(58) Field of Classification Search

CPC ..... A47L 5/18; F04F 5/467

USPC ..... 15/409; 417/151–198; 261/76

See application file for complete search history.

(56) References Cited

U.S. PATENT DOCUMENTS

| | | | | |
|---|---|---|---|---|
| 1,423,198 A | | 7/1922 | Davenport | |
| 2,863,525 A | * | 12/1958 | Lucian | A47L 5/18 15/409 |
| 4,026,682 A | * | 5/1977 | Pausch | B01D 47/10 138/45 |

(Continued)

FOREIGN PATENT DOCUMENTS

| | | |
|---|---|---|
| DE | 403 503 C | 9/1924 |
| DE | 40 23 464 A1 | 1/1992 |

(Continued)

*Primary Examiner* — Bryan R Muller

(74) *Attorney, Agent, or Firm* — Pearne & Gordon LLP

(57) ABSTRACT

The invention relates to a pneumatic vacuum in which an ejector (10) exhibits a tubular conduit (11) for injection of compressed air, a discharge channel (12) for discharging the aspirated fluid and the compressed air injected via the tubular conduit (11), an aspirating channel (13) in fluid communication with the tubular conduit (11) and the discharge channel (12) for aspirating; the ejector (10) has a first and a second tubular body (17, 24) exhibiting a first converging portion (20, 25) arranged downstream of an inlet zone (18) along an aspirating direction (21) and a second portion (22, 26) having a constant section emerging from the first converging portion (20, 25) at the smaller-section zone (23, 27) and downstream of the first portion (20, 25) along the aspirating direction (21), the tubular conduit (11) for injecting the compressed air exhibiting an inlet mouth (28) located at the converging portion (25) of the second tubular body (24) such as to inject pressurized air into the second tubular body (24).

18 Claims, 7 Drawing Sheets

(51) Int. Cl.
*F04F 5/00* (2006.01)
*F04F 5/20* (2006.01)

(56) References Cited

U.S. PATENT DOCUMENTS 5,531,639 A * 7/1996 Catalfamo ..... B24B 55/102 451/456
6,049,941 A 4/2000 Vollenweider, II
7,971,807 B2 * 7/2011 Iijima ..... A47L 5/14 15/300.1

FOREIGN PATENT DOCUMENTS

JP 2005-319351 A 11/2005
WO 01/45544 A2 6/2001

* cited by examiner

FIG.5
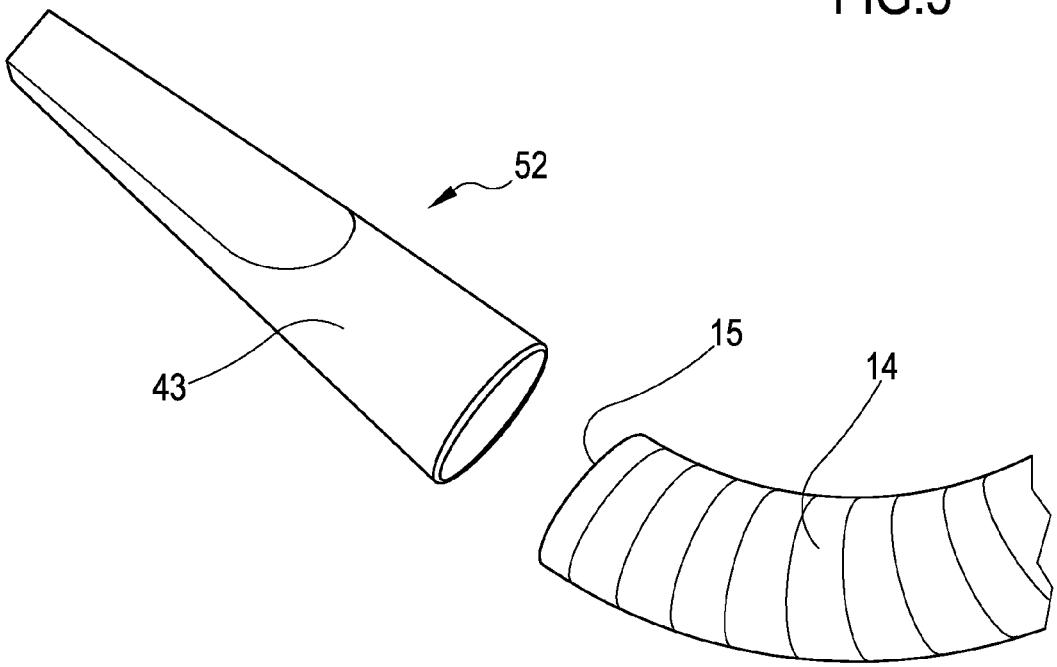
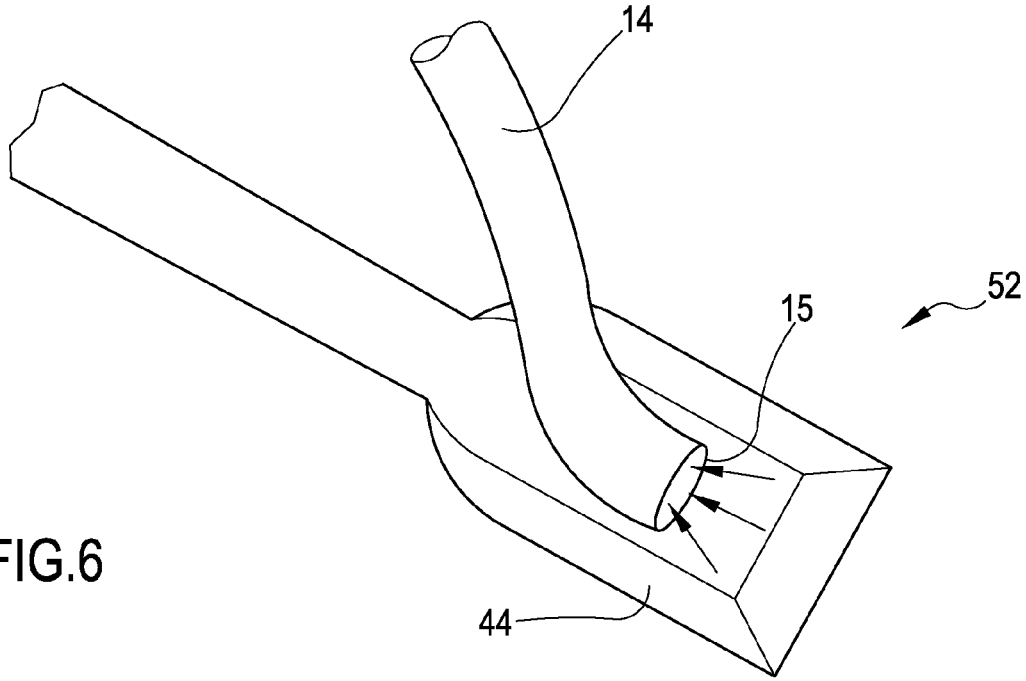
FIG.6

PNEUMATIC VACUUM CLEANER

TECHNICAL FIELD

The present invention relates to an air vacuum cleaner with improved efficiency and low air consumption.

The present pneumatic vacuum cleaner is particularly suitable for use in environments having a generation of dust.

In particular the pneumatic vacuum cleaner illustrated in the following is for example applied in bodywork or workshops where abrading devices are used for finishing surfaces of painted or non-painted surfaces, such as vehicle bodywork or portions thereof, with the aim of performing preparation operations of the manufactured product and subsequent work operations.

In other terms, the pneumatic vacuum cleaner of the present description can, by way of example, be coupled with devices for work operations using an abrasive body, for example a disc, the surface of a structure such as a vehicle body, a wooden article of furniture, a flooring or a stone door threshold, etc., in order to give a good finished appearance or to prepare the surface for a following finishing treatment, for example painting.

BACKGROUND

As is known, industrial aspiration plants today have to be in line with regulations described in the "ATEX" rules, i.e. the European Directive relating to materials and apparatus destined for use in potentially explosive atmospheres. The producers of aspirating plants and/or devices therefore have to provide apparatus that is adequate and the field of application of the rules involves gas and powders, and therefore work environments have to be purified by suitable aspirating plants. The Directive considers the risks of explosion of any type, electrical or otherwise, and classifies the apparatus into categories on the basis of the type of guaranteed protection, regulates the introduction of the essential safety requisites and oversees the production processes based on company quality systems. In this context the aspirating plants used in the companies take on an important role due to the very specific requests for prevention of risks deriving from potentially explosive atmospheres, and must also respond to essential safety and health requisites as they are apparatus destined to be used in potentially explosive atmospheres and/or in potentially explosive environments due to the presence of powders.

In this context, it seems clear that all actions involving abrasion operations generate a fine dust of abraded material which tends to diffuse into the environment, causing not only irritation but also potentially dangerous situations for the operator.

Further, the presence of dust during the abrading operations involves additional problems during the surface finishing of the manufactured product.

To cite a specific example, which is not intended to have a limiting value, in the sector of bodyworking and workshops, abrading devices are used for smoothing surfaces of painted products, and not for performing preparatory operations on the product for subsequent work operations. In this not-strictly industrial context, the problem of abraded dusts is particularly prominent. In fact, apart from additives which can be risky for health if breathed in or ingested, generally the parts of aluminium vehicles, when abraded, cause diffusion in the form of powder in the environment of metal particles which make the atmosphere in the working area inflammable and explosive. Today the market offers, and much use is made of, abrasive devices constituted by a support which exhibits an operating surface destined to receive a laminar abrading material, for example in paper form couplable to the support and exhibiting an active surface incorporated or clad in an abrasive material.

The support further exhibits gripping means for the user such that the user, when operating manually, can perform abrading operations for example on the bodywork element.

It is clear that this type of device is destined to generate much dust and abrading residues, with all the above-detailed problems.

To obviate at least a part of the above-cited drawbacks, use is made of abrading devices connected to electrical systems for aspirating the abraded material.

In any case, with the aim of generating sufficient aspirating forces, electric machines are today used which generate a depression, and which generically can substantially be called vacuum cleaners.

It is however evident that the presence of environments having a risk of explosion or fire, such as environments saturated with aluminium powders, are not very compatible with the presence of electric machines that can constitute the flashpoint for generation of the above-mentioned dangerous situations.

Further, the use of electrical aspiration systems of the above-described type leads in any case to a deterioration in terms of safety requisites to be respected internally of the workshop in such a way as to prevent the dangerous situations from actually obtaining.

SUMMARY

In this situation, the technical aim underpinning the following description is to substantially obviate the drawbacks and limitations as mentioned above.

A first aim is to provide a pneumatic vacuum device which is universal, but which is also without the limitations and drawbacks of common electrical vacuum cleaners.

An additional aim is to make available a pneumatic vacuum cleaner having low delivery air consumption in order to generate the desired levels of aspiration.

An additional aim is to provide a pneumatic vacuum cleaner having low delivery air consumption in order to generate the desired aspiration.

An additional objective is also to provide a pneumatic vacuum cleaner which improves the efficiency of aspiration without increasing the overall costs, and without the need for complex structural modifications or poorly-reliable components.

A further aim is also to make available a pneumatic vacuum cleaner which enables excellent collecting of the powders generated far from the aspirating mouth, such that the collecting container is not a hindrance to the operator working in the work zone.

A further aim is to provide the operator with a tool having aspirating function without intervening on the dimensions or weights of the work tool in use.

A further objective is to make available a pneumatic vacuum cleaner which has contained costs and is simple to implement.

A further objective is also to contain the electrical consumption for generating the depression by means of the pneumatic vacuum cleaner, while guaranteeing a sufficient aspirating force.

These and other aims besides, which will better emerge during the course of the following description, are substantially attained by a pneumatic vacuum cleaner, in accordance with one or more of the accompanying claims.

Further characteristics and advantages will more fully emerge from the detailed description of an embodiment, in accordance with what is described in the following.

BRIEF DESCRIPTION OF THE DRAWINGS

The description will be carried out with reference to the accompanying figures, which are provided purely by way of non-limiting example, in which:

FIGS. 5-7 are various possible parts of equipment associable to the pneumatic vacuum cleaner of FIG. 1, such as a mouth, a chisel or a surface-abrading device for products.

DETAILED DESCRIPTION

Figure 1:
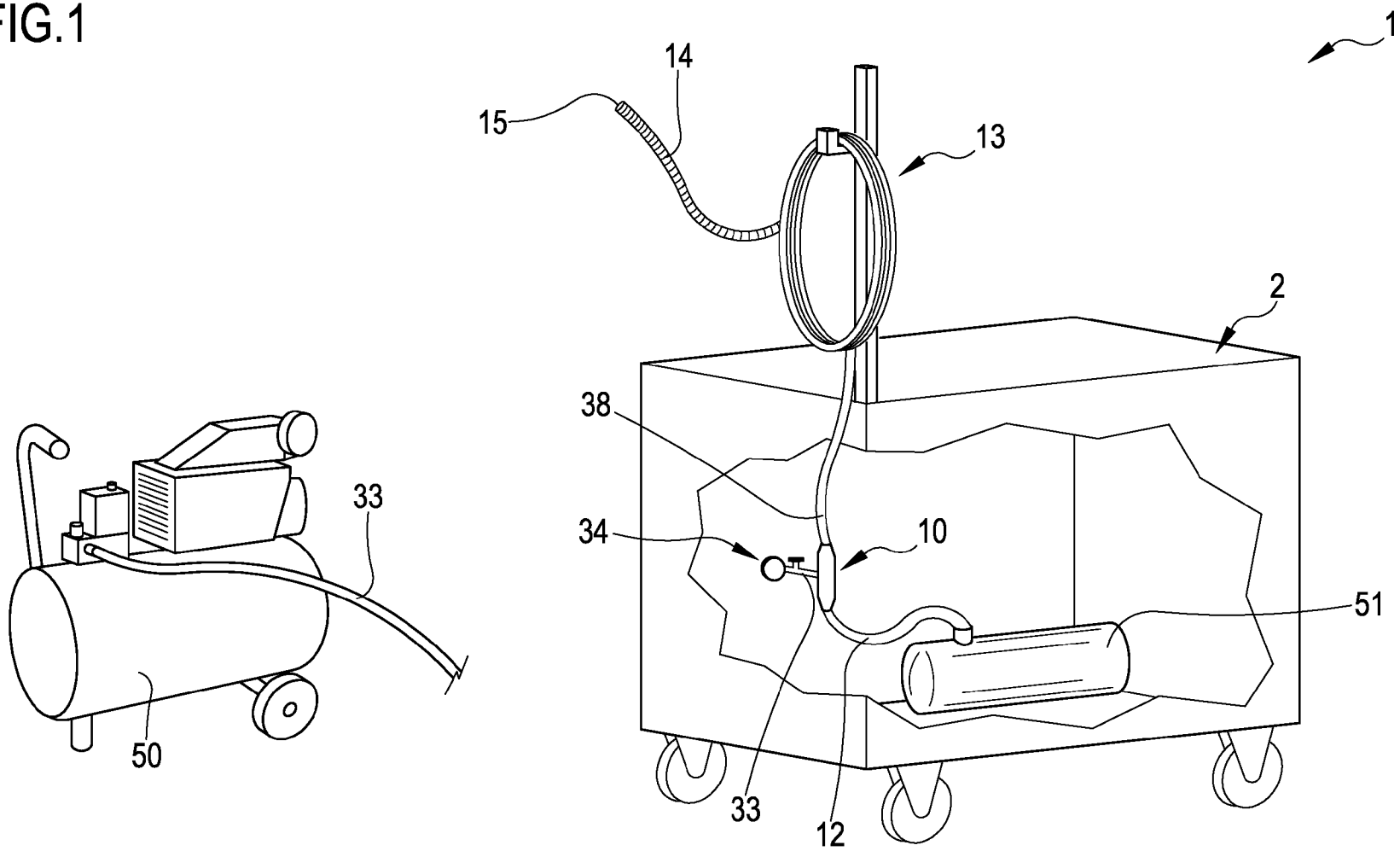
FIG. 1 is a schematic view of a pneumatic vacuum cleaner associable to a work tool.

With reference to the accompanying figures of the drawings, 1 denotes in its entirety the pneumatic vacuum cleaner that is usable (or not) in combination with work equipment such as nozzles, chisels, devices for surface abrasion of products, etc. Looking in particular at FIG. 1, the pneumatic vacuum cleaner exhibits a support frame 2 which can in general be defined by a mobile structure on wheels such as for example a carriage which can enable transport of the equipment itself and its positioning, in particular the positioning of the elements directly borne on the carriage, in the most advantageous zone of the environment where the support frame 2 is destined to be housed.

Obviously the support frame 2 could alternatively be defined by a common bench or similar fixed structure where the various components now to be described can be duly constrained.

The support frame 2 is destined to support a compressed-air injection channel originating from a common compressor 50 which might be in a different environment from the one in which the carriage operates. For example a common compressor could be used, even with a low power of for example 5 HP.

A pressure regulator 34 might be present (or not), associated to the air injection channel 33; the regulator 34 could be mounted on the frame and be commandable, for example manually, by a suitable valve 54 (or tap) such as to vary the pressure of the compressed air in inlet to the equipment.

Figure 8:
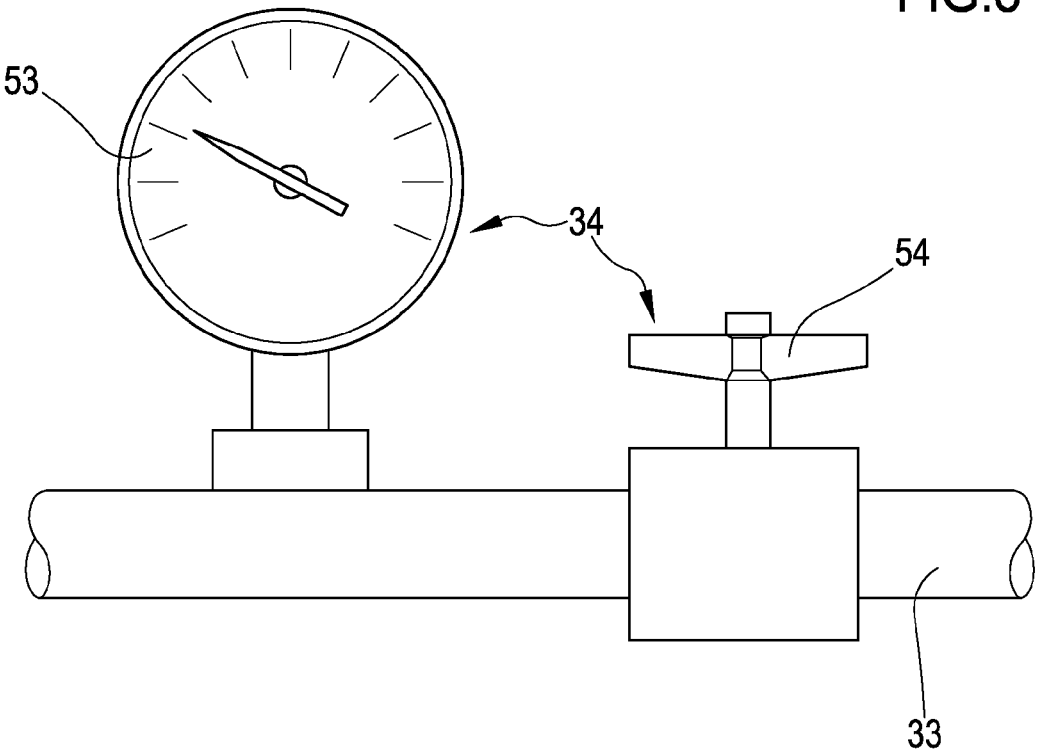
FIGS. 8 and 9 illustrate respective pressure regulators that can be used in the vacuum cleaner of FIG. 1.
Figure 9:
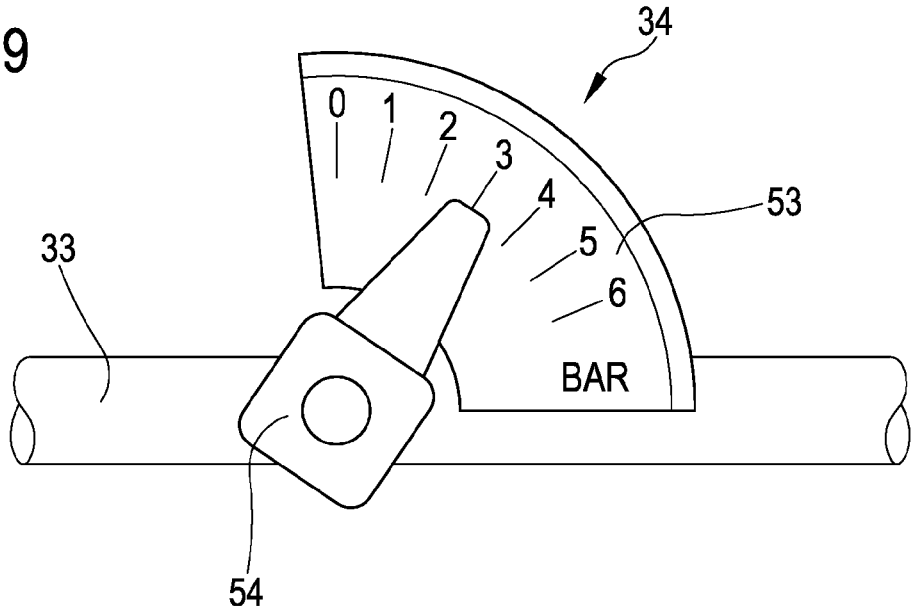

FIGS. 8 and 9 illustrate, in greater detail, two possible embodiments of the pressure regulator 34.

In general terms the pressure regulator 34 is configured such as to enable injection of compressed air at a known pressure value or which can be preset, selectable from among a plurality of permitted values.

In still other terms, the pressure regulator 34 can comprise a pressure indicator 53 configured such as to display a pressure value for the air injected via the tubular conduit 11.

For this purpose, the pressure indicator 53 can simply comprise visual indications which associate, to a work position (for example an angular position) of the opening/closing valve 54, a corresponding generated pressure (FIG. 9).

Alternatively (or in combination), in order to have an extremely reliable reading, the pressure indicator 53 will also comprise a pressure gauge (integrated or not) for reading the injection pressure of the compressed air flow into the ejector 10 (FIG. 8).

As a further variant, the pressure regulator 34 can comprise a plurality of preselectable discrete positions (for example with click notches—pressure 1, pressure 2, pressure 3 etc.) in order to inject compressed air at predefined/preset values which may even not be precisely known to the operator.

The above is particularly relevant in the light of the fact that the pneumatic vacuum cleaner 1 described finds its main (though not exclusive) application coupled with special work tools 52.

Figure 7A:
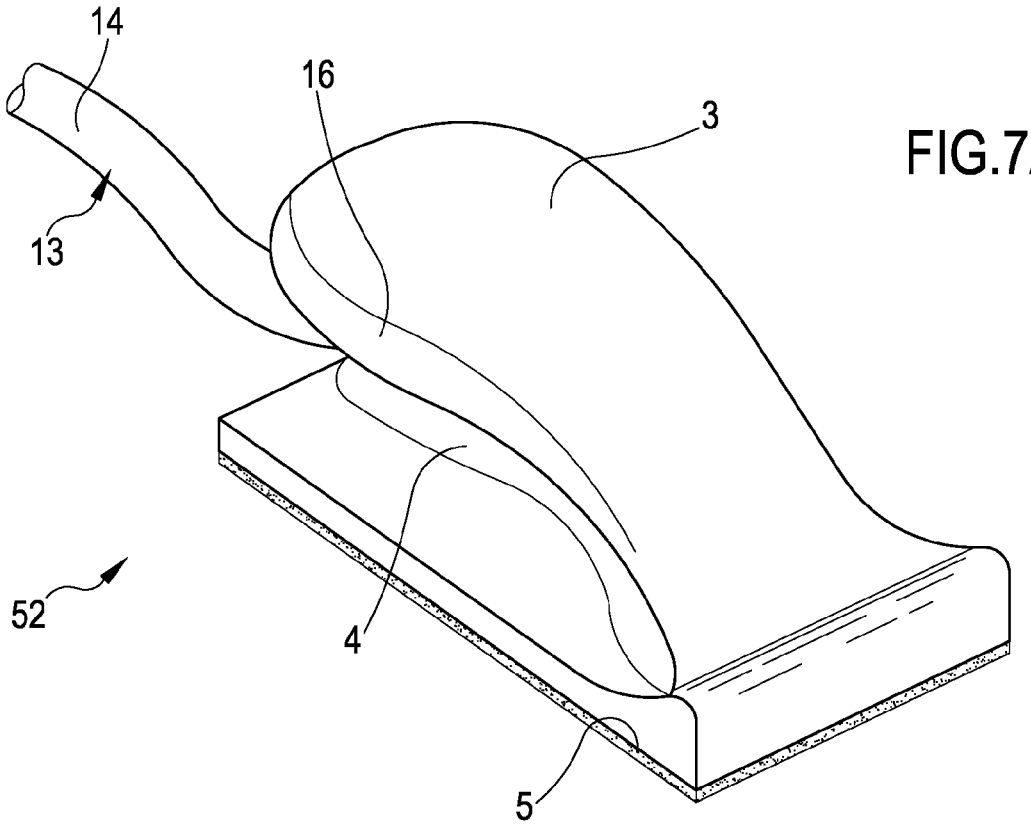
Figure 7B:
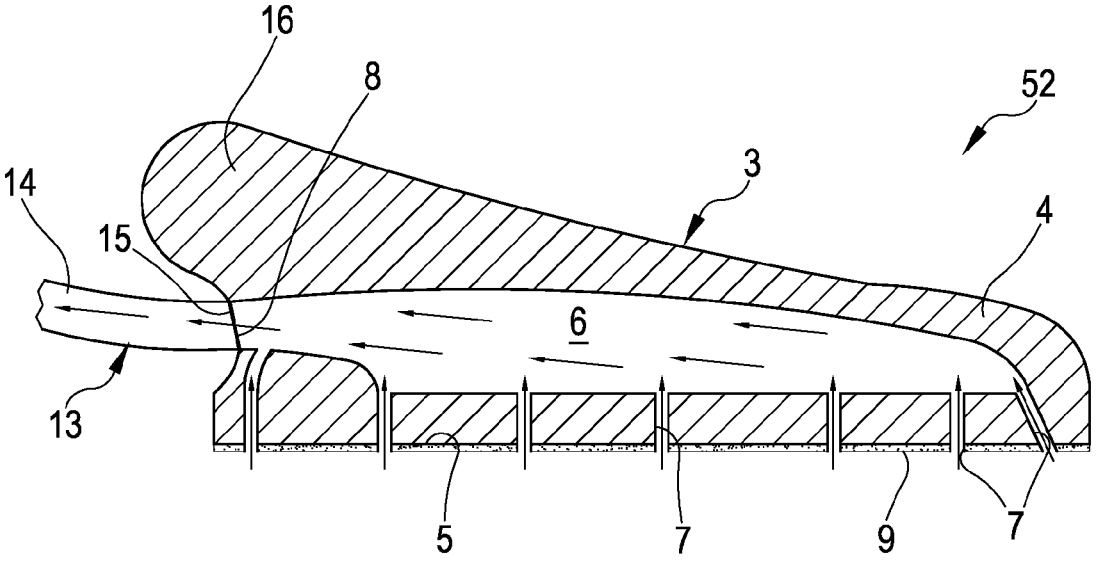

For example, figures from 5 to 7 illustrate some examples of these tools 52 and in detail a rigid mouth or nozzle 43 for reducing the free aspiration section, a chisel 44 having incorporate aspiration or a manual abrasive pad with aspiration of the dusts generated (FIGS. 7A, 7B).

As can be noted, the equipment further comprises an ejector 10, i.e. a device able to generate, with pneumatic systems, a depression which can enable aspirating at least a fluid (in general air and/or vapours and/or powders) from an environment.

In particular, the ejector 10 comprises at least a tubular conduit 11 for injecting compressed air into the structure as illustrated and described herein below (see for example FIGS. 2 and 3).

In general terms, the ejector 10 constitutes a mechanism for generating a depression which used compress and air, and without any need for direct electrical supply of any type.

Connected to the ejector 10 there are a discharge channel 12 for discharging the aspirated fluid from the environments (with any dusts or abraded particles contained internally thereof) and the compressed air injected via the tubular conduit 11.

In particular, the discharge channel 12 exhibits a first end directly or indirectly constrained to the ejector 10 (there might be a direct engagement of the end of the discharge channel 12 or also an engagement by interposing of further elements or adapters positioned between the ejector 10 and the discharge channel 12). Obviously the discharge channel 12 can also exhibit a first end realised in a single piece with the ejector 10.

The other end of the discharge channel 12 is destined to convey the aspirated fluid plus any other particulate material aspirated, in particular dusts, also aspirated, into a collecting zone.

In general the collecting zone will comprise a dust container 51 where the aspiration relates to an environment where there is air mixed with dust/particulate.

The collecting container 51 of the aspirated particulate is configured such as internally to retain the solid aspirated particles and to discharge to the outside the volumes of aspirated air.

In this sense it might be constituted by an air-permeable container (in the specific example having a permeability that is greater than 300 l/min) that is however not permeable to the aspirated dust.

Optionally the collecting container 51 is engaged to the support frame 2 and is distant from the work zone.

Again from the general point of view, there is also as aspirating channel 13 in fluid communication with the tubular conduit 11 and the discharge channel 12.

The aspirating channel 13 exhibits an end 38 which is directly or indirectly constrained to the ejector 10 (it could be a directly engaged to the end of the aspirating channel 13 or also an engagement with interposing of further elements, or adapters interposed and positioned between the ejector and the aspirating channel 13).

Further, the aspirating channel could be made in a single piece (monolithic) with the ejector 10.

In particular, the aspirating channel 13 is destined to aspirate the fluid (in general air and solid particles) from the environment, as will be better clarified in the following.

Figure 2:
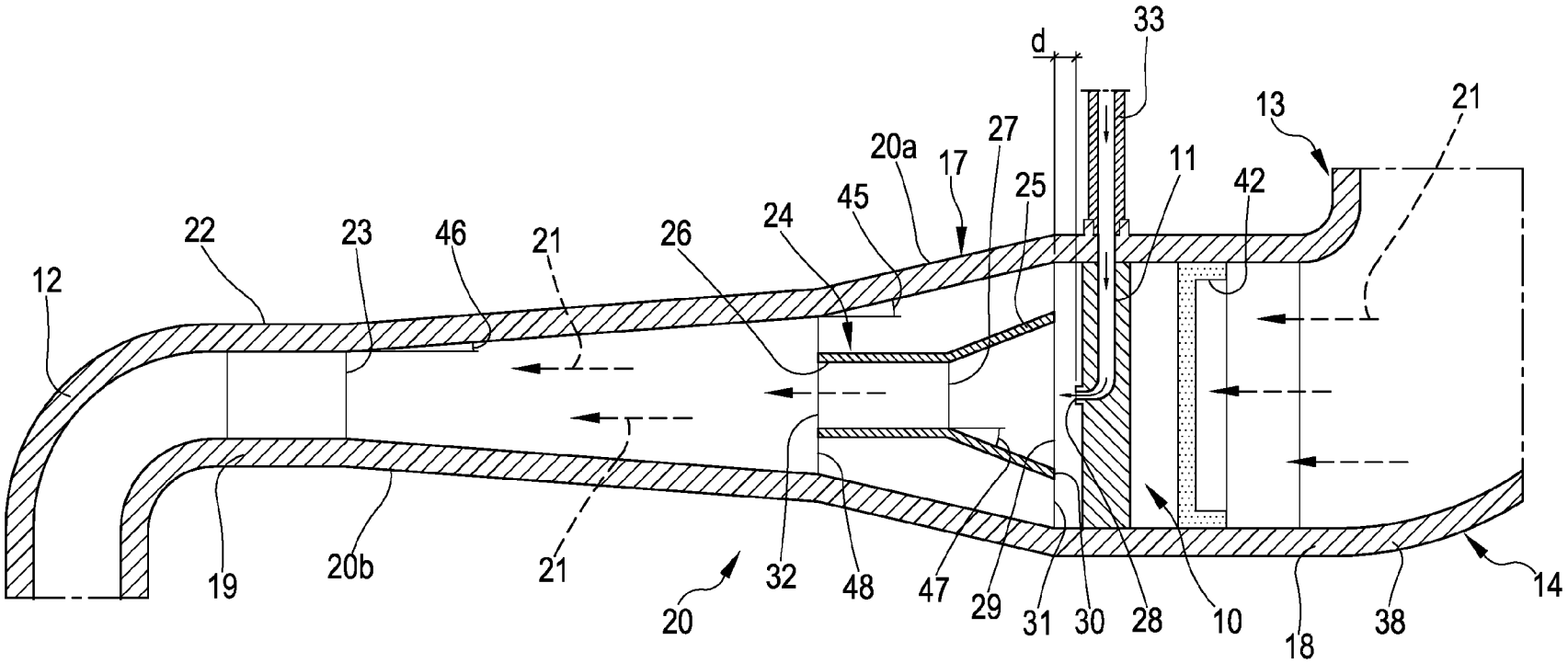
FIG. 2 illustrates a constructional detail of an ejector incorporated in the pneumatic vacuum cleaner of FIG. 1.
Figure 3:
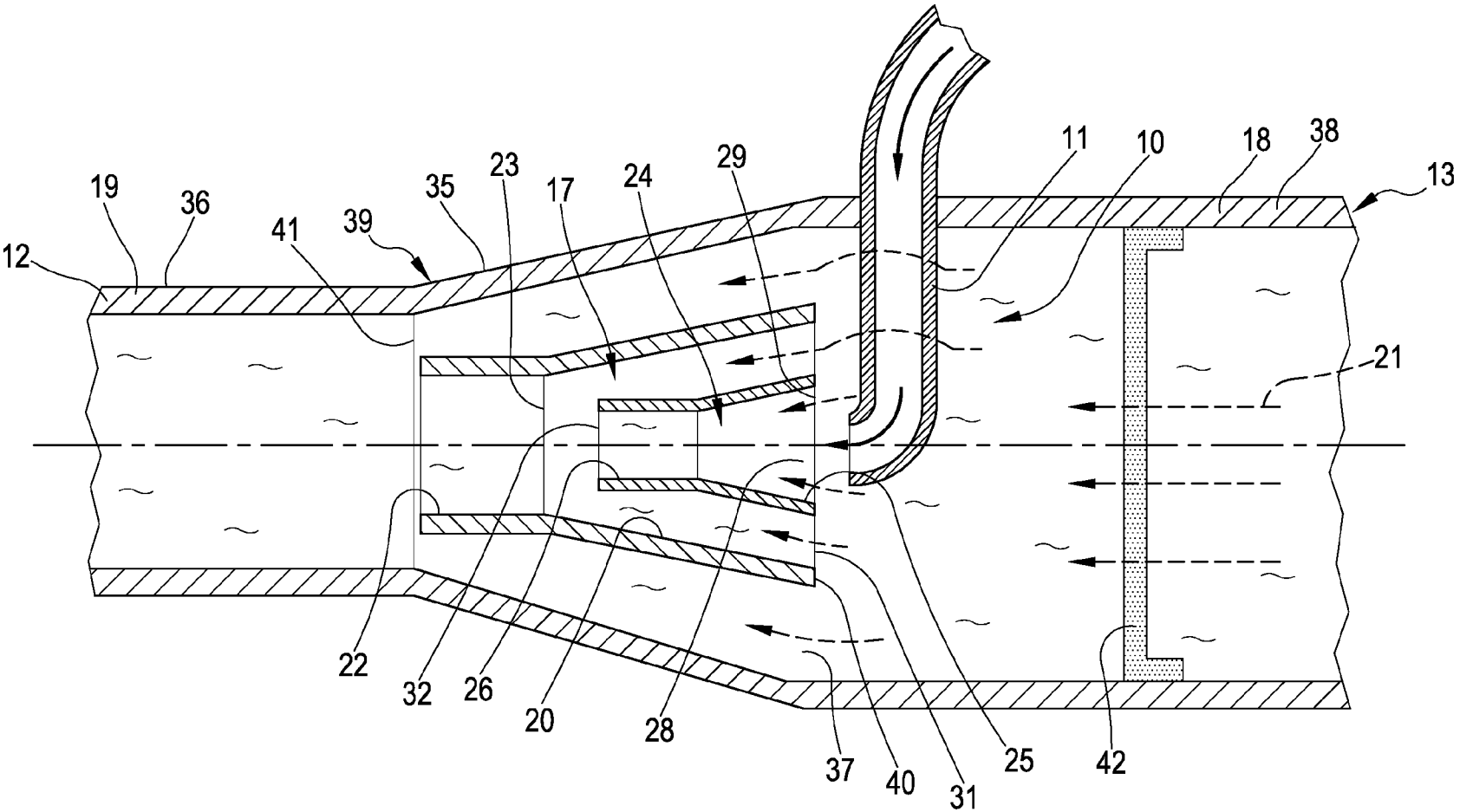
FIG. 3 is a variant of the ejector of FIG. 2.
Figure 4:
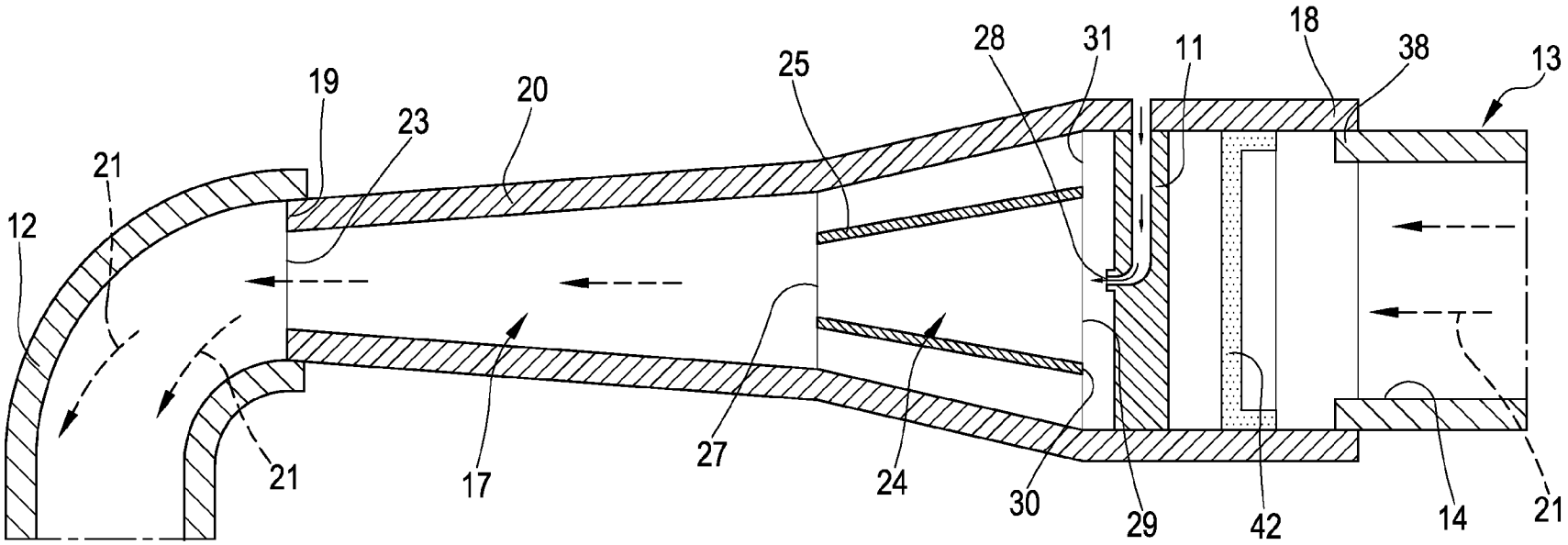
FIG. 4 is a further variant of the ejector of FIG. 2.

In more constructional detail, in the ejector 10 illustrated in FIGS. 2, 3 and 4 is three possible manufactured variants, the following can be observed.

The pressurised air coming from the compressor is injected into the tubular conduit 11 via the injection channel 33 (in this case too directly or indirectly by means of the interposing of further elements or adapters).

The ejector 10 is constituted principally by a first tubular body 17, in general having a cylindrical symmetry, exhibiting an inlet 18 in fluid communication with the aspirating channel 13 and an outlet 19 in fluid communication with the discharge channel 12 (made in a single piece, solidly or removably connected as required).

These illustrated attachments, as direct attachments can be obtained also by interposing of suitable adapters or connectors, where necessary.

The first tubular body 17 comprises, observing it along an aspirating direction 21, presence (optional) of a first tract having a constant section, substantially cylindrical, which in general exhibits the inlet 18 in fluid communication with the aspirating channel 13 and a first converging portion 20 arranged immediately and consecutively downstream of the first constant-section tract and profiled substantially truncoconically at least in a tract thereof.

In the embodiment of FIG. 2 the first converging portion 20 exhibits two tracts 20*a*, 20*b* having different conicity, the first tract 20*a* being more greatly inclined, the second tract 20*b* being longer than the first, but having a smaller conicity.

In particular, the two conicities are constant.

The two conical tracts 20*a*, 20*b*, connect at a junction zone 48 between the minimum section of the first tract 20*a* and the maximum section of the second tract 20*b*.

The first converging portion 20 (tracts 20*a* and 20*b*) is followed by a second portion 22 having a substantially constant section (in general circular) emerging from the first converging portion 20 (and in detail from the second tract 20*b*) at the smallest-section zone 23 thereof and downstream of the first portion 20 along the aspirating direction 21.

The outlet zone 19 is positioned downstream of the second portion 22 along the aspirating direction 21, as clearly illustrated in FIG. 2.

The ejector further comprises a second tubular body 24 which is positioned (and in general directly constrained) internally of the first tubular body 17 and also exhibits a second converging portion 25 and a second portion 26 having a substantially constant section emerging (directly and consecutively) from the second converging portion 25 at the smallest-section zone 27.

The second tubular body 24 also exhibits a cylindrical symmetry and the second converging portion 25 is defined by a truncoconical longitudinal section, while the second portion has a constant circular section.

As can be noted, the tubular conduit 11 for the injection of compressed air exhibits an outlet mouth 28 located (and for example, though not necessarily, slightly internally along the advancement direction of the aspiration 21) at the second converging portion 25 of the second tubular body 24 with the aim of injecting pressurised air into the second tubular body 24.

The outlet mouth 28 has in general a smaller section than the inlet section of the second converging portion, in such a way as to define an additional area 29 for fluid in inlet in the second converging portion 25.

As shown in the figures, the outlet mouth 28 is positioned substantially along the axis of symmetry of the device, such as to define the additional area 29 for fluid inlet as a circular crown. The inlet of pressurised air into the converging conduit increases the velocity thereof, reducing the pressure and thus creating a zone under aspirating depression at the additional area 29 which entrains fluid from the aspirating channel 13.

As can be noted, the second tubular body 24 is arranged substantially at the first converging portion 20 of the first tubular body 17 internally of which it is entirely housed. In particular, the second tubular body 24 is arranged substantially at only the first tract 20*a* of the first converging portion 20, terminating in proximity of the junction zone 48.

In this case too the inlet section 30 of the second converging portion 25 of the second tubular body 24 is smaller than the inlet section of the first converging portion 20 (maximum inlet section of the first tract 20*a*) of the first tubular body 17 in such a way that an additional area 31 is defined for inlet of a fluid into the first converging portion 20 of the first tubular body 17.

In this case too, the depression generated in outlet from the constant-section tubular portions 22 and 26 generates the above-mentioned depression, also at the addition area 31, such as to increase the aspirating force in the channel 13.

Note how the second portion 26 of the second tubular body 24 exhibits an outlet mouth 32 located upstream (at the most at an initial tract) of the smaller-section zone 23 of the first converging portion 20 along the aspirating direction 21.

In still more detail, the second portion 26 of the second tubular body 24 exhibits an outlet mouth 32 located upstream (at most at an initial tract) of the junction zone 48 between the first and the second tract 20*a*, 20*b* of the first converging portion 20 along the aspirating direction 21.

With reference to the specific example of FIG. 2, the first tubular body 17 will have a length of the first converging-section tract 20*a* (along the aspirating direction) which is three times the length of the constant-section tract 22 and the second converging tract 20*b* having a length (along the aspirating direction) which is 4.5 times the length of the constant-section tract 22.

The largest diameter of the first tubular body 17 at the inlet section to the first converging tract 20*a* is about 1.68 times the outlet diameter of the constant-section portion 22.

The first angle of conicity 45 between the first converging tract 20*a* and the axis of development of the ejector 10 is comprised between 10 and 15 degrees, while the second angle of conicity 46 between the second converging tract 20*b* and the axis of development of the ejector is comprised between 0 and 9 degrees. In particular the first angle of conicity 45 will be about 13 degrees; the second angle of conicity 46 will be about 4 degrees. In absolute terms the overall length of the first tubular body 17 can be 85 mm and the maximum diameter 33.5 mm.

With reference to the second tubular body 24, the ratio between the length of the substantially-constant second portion 26 (again measured along the aspirating direction) is about 2.

The largest diameter of the second tubular body 24 at the inlet section to the second converging portion 25 is about 1.9 times the outlet diameter of the constant-section portion 26.

The angle of conicity 47 between the second converging portion 25 and the axis of development of the ejector 10 is comprised between 20° and 40°, more in detail between 27 and 40 degrees, and in particular between 32 and 33 degrees.

In absolute terms, the overall length of the second tubular body can be 30 mm and the maximum diameter 27.5 mm.

A ratio between an overall length of the first tubular body and an overall length of the second tubular body is greater than 2 and less than 3.5.

The ratio between the free area of passage defined by the circular crown 29 and the free area of passage for the compressed air defined by the outlet mouth 28 is comprised between 15 and 30 and is in particular 22.9, while the ratio between the free area of passage defined by the circular crown 31 and the free area of passage for the compressed air defined by the outlet mouth 28 is comprised between 5 and 15 and is in particular 10.7.

Obviously other absolute dimensions are equally comprised in the concept of the present solution.

At this point it should be noted that, given equal geometries of the ejector 10, an increase in the section of the outlet mouth 28 (obtained by reducing the thickness of the mouth, i.e. without intervening on the dimensions of the free crown of passage defined by the area 29) enables working with higher compressed air pressures; however in order to improve the aspirating performance, once the pressure has been increased, i.e. the volumes of air injected per unit of time, it should be advantageous to intervene on the angle of conicity 47 in order to reduce it, i.e. reduce the area of the circular crown 29.

To further increase the aspirating performance after having increased the compressed-air injection pressure and having varied the angle, as clarified herein above, in particular when there is a considerable increase in liters per minute of air injected, it can be advantageous to reduce the length of the constant-section portion 26 in order to reduce the resistance to the motion of the air having greater volumes.

It is also advantageous that the first converging tract 20*a* should terminate where the constant-section portion 26 also ends, i.e. the corresponding angle of conicity 47 should be increased. With reference to FIG. 3, a variant of what is illustrated in figure is shown.

In FIG. 3 the same numerical references of corresponding portions illustrated in FIG. 2 have been used for items that are identical; and these items will not be further described. The variant of FIG. 3 comprises a further converging channel 35 internally of which the first and second tubular bodies 17, 24 are substantially housed.

The converging channel 35, with truncoconical section, is followed at the smallest section thereof by a section having a substantially constant section 36.

The above generates a third additional area 37 at which a depression is present, also intended to increase the depression in the aspirating channel 13.

For the symmetry of the portions of tubular body, the third additional area also has a circular crown shape.

FIG. 4 illustrates a possible further variant of the device of FIG. 2, in which the tubular bodies 17 and 24 comprise the respective first and second converging portions 20 and 25, but not the constant-section portions 22, 26 consecutively associated; in other terms, the second tubular body 24 is constituted exclusively by the conical second converging portion 25, while the first tubular body has the respective first conical portion 20 which couples directly to the discharge channel 12 at the smallest-section zone 23 thereof. In this case too the first conical portion might, alternatively to what is shown, comprise two (or more) tracts having distinct conicity, a first more-inclined tract followed by a second less-inclined tract (not illustrated).

Returning to FIG. 1, note the presence of the aspirating channel 13, which comprises a flexible tube 14 such as to be able to vary its geometry as required in order to give an abrading device (described herein below) to take on a plurality of relative positions that are different with respect to the ejector 10.

In particular the flexible tube 14 can be defined by a channel made of a plastic material, made of metal or cloth surface, suitable shaped or configured such as to be able to vary the geometry as required.

In still other terms, a flexible tube is a conduit (especially made of plastic material such as for example PVC and polyethylene) which has the tendency to deform along diametral axes by effect of its own weight and/or insistent loads.

In order to keep the section of the tube unchanged, generally the tube exhibits circular ribs flanked with recesses (corrugated tube) which enable optimal flexibility without detracting from the structural characteristics of the tube and preventing kinking or folding phenomena.

In general, the flexible tube can have a similar structure to the aspirating tubes of common vacuum cleaners.

The flexible tube is configured such as to enable a distancing between the tool (for example the abrading device 3) and the ejector 10 to a distance of at least 20 cm in a case in which the ejector is associated to automatic machines.

In these applications the distance of 20 cm can enable an easy movement of the active head of the machine without the ejector 10 hampering the motion.

In other applications where human intervention is required for moving the tool, the ejector 10 will in general be at least 50 cm from the distal terminal end 15 of the flexible tube and in greater detail at least a meter, if not at a distance of at least a meter and a half.

In other terms the flexible tube 14 has a considerable free length and can reach lengths of even longer than 2.5 meters according to operating requirements.

The lengths of the aspirating tubes today required to guarantee easy operativity for the user are in particular at least 3 meters and reach up to 5 meters, or even more.

The internal aspirating diameters are comprised between 18 and 52 mm, preferably between 18 and 35 mm, with an optimal standard value of 29 mm.

The other end of the flexible tube exhibits an aspirating mouth 15 (distal terminal end) which can also define an attachment for a further aspirating mouth (for example having a small section) or even any tool 52 which requires generation of an aspiration as illustrated in the following.

To prevent possible damage to the depression-creating system, i.e. to the ejector 10, a protecting element 42 can also be present, such as a screen or the like, positioned upstream of the tubular injection conduit 11 along the aspirating direction 21.

The figures schematically illustrate possible tools that can be associated to the pneumatic vacuum cleaner.

FIG. 5 shows a common vacuum cleaner mouth 43, for reducing the free aspirating section with respect to the free section of the distal terminal end.

FIG. 6 illustrates a chisel 44 with integrated aspiration borne by the flexible tube 14 of the vacuum cleaner.

FIGS. 7A and 7B show a manual device 3 for surface abrading of a structure connectable to the above-described pneumatic vacuum cleaner.

The device 3 in general comprises a support body 4 which exhibits a smaller coupling surface 5 and optionally an aspirating chamber 6 in fluid communication with the outside, through a predetermined number of openings 7, in general through-openings, present on the coupling surface 5.

Obviously, alternatively the channel or channels which develop from the openings 7 can converge directly to an aspirating opening 8 without any need to realise a true and proper aspirating chamber.

The abrading device 3 is further provided with at least the aspirating opening 8 set in fluid connection with the aspirating channel 13.

In particular the aspirating channel 13 comprises a connecting mouth 15, which is removably connectable to the aspirating opening 8 of the aspirating channel 6 of the support body 4.

The removable connection enables the use of the tool with various devices 3 for surface abrading that can be replaced according to the task to be performed, while exploiting the support frame 2 and the ejector 10.

The connection, which is in any case removable, can be achieved directly or indirectly, i.e. the free end 15 of the flexible tube 14 can be directly engaged to the aspirating opening 8 or an adapter or other element can be interposed.

In any case the free length of the aspirating channel 13 is sufficient to enable use of the abrading device by a user, without any need to correspondingly move the ejector 10.

In other terms, the ejector 10, for example mounted on the carriage, can be positioned in any optimal zone of an environment and thus the abrading device can be used without the support frame having to be further moved or without its hampering work operations.

Note that the support frame mounting the ejector 10 might be positioned in a first environment, while the work operation is done in a second environment protected from further barriers with respect to the first, should it be necessary.

With the aim of indicating, by way of example, some operating parameters, the pneumatic vacuum cleaner according to what is described in the example of FIG. 2 with the specific geometries previously indicated can use a flexible aspirating tube of about 3 meters long with a free aspirating section of 29 mm; the air consumption is 300 liters per minute (about) with an operating pressure in the compressed-air injection channel of between 2 and 3 bar. The aspirating efficiency is greater than 99%, even with the abrading tool (and aspirating point) in contact but in movement.

In the same conditions, the known pneumatic vacuum cleaners must work at 6-8 bar working pressure in order to guarantee results that are only close to those obtained by the geometries of the present embodiment.

The depression at the terminal distal end 15 measures the ability of the aspirating device to lift the particles present, for example from the working surface. It is calculated at the end of the mouth of the flexible tube and is expressed in kilo-Pascals (kPa): the higher the value, the greater the lifting capability. The device of the embodiment is able to generate a depression of at least 5 kPa with compressed air pressures of between 2 and 3 bar (and air consumption of 200-300 liters per minute), and can arrive even beyond 10 kPa by increasing the compressed air pressure at about 4 bar (air consumption of about 400 liters/min). Returning to FIG. 7A, the abrading device 3 illustrated therein can possible also comprise a special abrading body 9, in general realised in laminar material, such as a paper or plastic support which exhibits a working surface destined, in use conditions, to be facing towards the abrading structure.

The opposite surface of the abrading body 9 is constrained to the coupling surface 5 of the body.

In general the abrading body 9 can be provided with suitable holes corresponding to the openings 7 present on the support body 4 or in any case with recesses or other solutions suitable for enabling aspiration of the abraded particles in the presence of a depression in the aspirating chamber 6.

Working in this way, the abraded particles and the fluid under depression are aspirated into the aspirating chamber 6 and thus conveyed via the aspirating channel 13 and the discharge channel 12 to the collecting zone.

Lastly note how the abrading device 3 can comprise at least a profiled gripping portion 16 for manual movement thereof.

No ejector 10 is present or mounted on the abrading device 3, and therefore the ejector 10 constitutes a very contained weight and size which is of no hindrance to the operator.

In this way an optimal operability of the tool is guaranteed, thanks to its small dimensions and further any eventual problems of a medical nature are eliminated, connected not only to the removal of the powders but also to the absence of weights (which is translated into a smaller physical exertion for the operator) with reference both to the tool and to any eventual dust collecting chamber which is to be continually moved, or worse, be carried on the body.

Further, in a remote position the ejector enables replacement of the work tool while continuing to use aspiration, even at a distance, which makes the pneumatic vacuum cleaner universally utilisable.

The tool could alternatively be constituted by more complex devices able to place, for example, a suitable abrasive disc in rotation; however these devices are not further detailed as they are not of interest with reference to the present description.

The above-described pneumatic vacuum cleaner enables implementation of a method for aspirating abraded material in which following predisposing of the ejector and the aspirating channel it is possible to removably connect the aspirating channel 13 to the ejector 10, pneumatically activate the ejector and then manually move a work tool such as the abrading device with respect to the structure to be abraded and with respect to the ejector during the normal stages of use of the device 3.

Further, the method for aspirating described enables replacement and use of a plurality of different abrading devices 3 without having to replace the support frame 2 and the ejector 10.

The above-described embodiments provide important advantages. Primarily, a pneumatic vacuum cleaner can be provided which is extremely simple and universal and which is usable itself for dust-aspirating functions of the dusts and small particles, as well as with the most varied tools which require aspiration, for example a plurality of different abrading devices.

The generating of a depression by pneumatic means leads to an increase in safety of the equipment, as electrical connections are not present at the working zone, which electrical connections might be the cause of sparks or detonation, especially in the presence of inflammable or explosive materials.

The efficiency of aspiration, though there is a considerable distance between the ejector and the tool, has been shown to be surprisingly high, greater than could be expected.

The consumption of air for generating the desired depression also appears to be much less than that of the corresponding devices exploiting the venturi effect. Lastly, the simplicity and the low constructional cost, connected to the intrinsic safety and operating functionality, make the equipment described herein extremely advantageous.

The invention claimed is:

1. A pneumatic vacuum cleaner comprising:

an ejector for generating a depression suitable for enabling aspiration of at least a fluid from an aspirating zone, the ejector comprising at least a tubular conduit for injecting compressed air;

at least a discharge channel for discharging the aspirated fluid and the compressed air injected via the tubular conduit; and at least an aspirating channel in fluid communication with the tubular conduit and the discharge channel in order to aspirate the fluid from a chamber, the aspirating channel comprising a distal terminal end and a flexible tube having the distal terminal end for enabling the distal terminal end to assume a plurality of different relative positions with respect to the ejector, the ejector comprising:

a first tubular body, exhibiting:

an inlet zone in fluid communication with the aspirating channel and an outlet zone in fluid communication with the discharge channel;

a first converging portion located downstream of the inlet zone along an aspirating direction, the outlet zone being positioned downstream of the first converging portion along the aspirating direction, the first converging portion of the first tubular body comprises a first tract and a second tract successively arranged along the aspirating direction, the first and the second tract exhibiting differentiated convergences, an angle of conicity defined between the first tract and a longitudinal axis of the first tubular body being greater than the corresponding angle of conicity defined between the second tract and the longitudinal axis of the first tubular body, said corresponding angle of conicity defined between the second tract and the longitudinal axis of the first tubular body being less than 9 degrees, and a second tubular body associated at least partly internally of the first tubular body and exhibiting a second converging portion, the tubular conduit for the injection of compressed air exhibiting an outlet mouth at the second converging portion of the second tubular body for injecting pressurised air into the second tubular body, the outlet mouth having a smaller section than an inlet section of the second converging portion such as to define an additional area of fluid inlet into the second converging portion, the inlet section of the second converging portion of the second tubular body being smaller than the inlet section of the first converging portion of the first tubular body such as to define a second additional area for inlet of a fluid into the first converging portion of the first tubular body, wherein an angle of conicity defined between the second converging portion of the second tubular body and a longitudinal axis of the second tubular body is greater than the corresponding angle of conicity defined between the second tract and the longitudinal axis of the first tubular body and is comprised between 27° and 40°, the angle of conicity defined between the second converging portion of the second tubular body and the longitudinal axis of the second tubular body is greater than the corresponding angle of conicity defined between the first tract and the longitudinal axis of the first tubular body.

2. The pneumatic vacuum cleaner of claim 1, wherein the first tubular body exhibits a second portion having a substantially constant diameter and emerging from the first converging portion at the smallest-section zone and downstream of the first converging portion along the aspirating direction, the outlet zone being positioned downstream of the second portion along the aspirating direction.

3. The pneumatic vacuum cleaner of claim 1, wherein the second tubular body associated to the first tubular body exhibits a second portion having a substantially constant diameter emerging from the second converging portion at the smallest-section zone, the second tubular body being positioned internally of the first tubular body substantially at the first converging portion of the first tubular body.

4. The pneumatic vacuum cleaner of claim 3, wherein the second portion of the second tubular body exhibits an outlet mouth located upstream of the smallest-section zone of the first converging portion along the aspirating direction.

5. The pneumatic vacuum cleaner of claim 3, wherein the second portion of the second tubular body exhibits an outlet mouth aligned with the intersection of the first and second tracts of the first converging portion along the aspirating direction.

6. The pneumatic vacuum cleaner of claim 1, wherein the flexible tube exhibits a free length which is sufficient for enabling use of the aspirating device by a user without any need for correspondingly moving the ejector.

7. The pneumatic vacuum cleaner of claim 1, wherein the flexible tube exhibits a free internal aspirating diameter comprised between 18 and 52 mm.

8. The pneumatic vacuum cleaner of claim 1, further comprising a device for surface abrasion of a structure, the device comprising:

a support body exhibiting a coupling surface and at least an aspirating channel or an aspirating chamber in fluid communication with the outside via one or more openings present on the coupling surface and provided with at least an additional aspirating opening;

an abrading body, made of a laminar material, exhibiting a work surface configured, in use conditions, to be facing towards the structure to be abraded and provided with an abrasive material and an opposite surface to the working surface and constrained to the coupling surface of the support body, the abrasive body enabling aspiration of the abraded particles in a presence of a depression in the aspirating chamber or in the aspirating channel.

9. The pneumatic vacuum cleaner of claim 8, wherein the abrading device comprises at least a profiled gripping portion for manual movement thereof, no ejector being present and mounted on the abrading device.

10. The pneumatic vacuum cleaner of claim 1, further comprising an injection channel of compressed air connected to the tubular conduit and a pressure regulator mounted on a support frame and acting on the injection channel to vary the pressure of the compressed air, the pressure regulator being configured to enable an injection of compressed air at a known pressure value or a preset value selectable from among a plurality of allowed values.

11. The pneumatic vacuum cleaner of claim 10, wherein the pressure regulator comprises a pressure indicator configured to display a pressure value of the air in inlet via the tubular conduit and/or comprises a plurality of discrete pre-selectable positions for injecting compressed air at predefined values.

12. The pneumatic vacuum cleaner of claim 1, comprising:

at least a collecting container of aspirated particulate, the collecting container being configured to internally retain the solid aspirated particles and to discharge the volumes of aspirated air to the outside;

a support frame, the collecting container being engaged to the support frame, the support frame bearing also the ejector.

13. The pneumatic vacuum cleaner of claim 1, wherein a ratio between an overall length of the first tubular body and an overall length of the second tubular body is greater than 2 and less than 3.5.

14. The pneumatic vacuum cleaner of claim 1, wherein a ratio between the free area of passage defined by the additional area and a free area of passage for the compressed air defined by the outlet mouth is comprised between 15 and 30.

15. The pneumatic vacuum cleaner of claim 1, wherein a ratio between the second additional area and the free area of passage for the compressed air defined by the outlet mouth is comprised between 5 and 15.

16. A pneumatic vacuum cleaner comprising:

an ejector for generating a depression suitable for enabling aspiration of at least a fluid from an aspirating zone, the ejector comprising at least a tubular conduit for injecting compressed air;

at least a discharge channel for discharging the aspirated fluid and the compressed air injected via the tubular conduit; and at least an aspirating channel in fluid communication with the tubular conduit and the discharge channel in order to aspirate the fluid from a chamber, the aspirating channel comprising a distal terminal end and a flexible tube having the distal terminal end for enabling the distal terminal end to assume a plurality of different relative positions with respect to the ejector, the ejector comprising:

a first tubular body, exhibiting:

an inlet zone in fluid communication with the aspirating channel and an outlet zone in fluid communication with the discharge channel;

a first converging portion located downstream of the inlet zone along an aspirating direction, the outlet zone being positioned downstream of the first converging portion along the aspirating direction, the first converging portion of the first tubular body comprises a first tract and a second tract successively arranged along the aspirating direction, the second tract being longer than the first tract along the aspirating direction, an angle of conicity defined between the first tract and a longitudinal axis of the first tubular body being greater than the corresponding angle of conicity defined between the second tract and the longitudinal axis of the first tubular body; and a second portion having a substantially constant diameter and emerging from the first converging portion at the smallest-section zone and downstream of the first converging portion along the aspirating direction, the outlet zone being positioned downstream of the second portion along the aspirating direction;

a second tubular body positioned internally of the first tubular body substantially at the first converging portion of the first tubular body and exhibiting:

a second converging portion, the tubular body for the injection of compressed air exhibiting an outlet mouth at the second converging portion of the second tubular body for injecting pressurised air into the second tubular body, the outlet mouth having a smaller section than an inlet section of the second converging portion such as to define an additional area of fluid inlet into the second converging portion, the inlet section of the second converging portion of the second tubular body being smaller than the inlet section of the first converging portion of the first tubular body such as to define a second additional area for inlet of a fluid into the first converging portion of the first tubular body, a second portion having a substantially constant diameter emerging from the second converging portion at the smallest-section zone, the second portion of the second tubular body exhibiting an outlet mouth aligned with the intersection of the first and second tracts of the first converging portion along the aspirating direction, wherein an angle of conicity defined between the second converging portion of the second tubular body and a longitudinal axis of the second tubular body is greater than the corresponding angle of conicity defined between the second tract and the longitudinal axis of the first tubular body, the angle of conicity defined between the second converging portion of the second tubular body and the longitudinal axis of the second tubular body is greater than the corresponding angle of conicity defined between the first tract and the longitudinal axis of the first tubular body.

17. A pneumatic vacuum cleaner according to claim 16, wherein a length of the first tract of the first converging portion along the longitudinal axis is three times a length of the second portion of the first tubular body and a length of the second tract of the first converging portion along the longitudinal axis is 4.5 times the length of the second portion of the first tubular body.

18. The pneumatic vacuum cleaner of claim 16, wherein an angle of conicity of the first converging portion of the second tubular body is comprised between 20° and 40°.

* * * * *